United States Patent [19]

Fujiwhara et al.

[11] 4,210,715

[45] Jul. 1, 1980

[54] LIGHT-SENSITIVE SILVER HALIDE PHOTOGRAPHIC MATERIAL AND METHOD OF PROCESSING THEREOF

[75] Inventors: Mitsuto Fujiwhara; Syunji Matsuo; Toyoaki Masukawa; Yutaka Kaneko; Mikio Kawasaki, all of Hino, Japan

[73] Assignee: Konishiroku Photo Industry Co., Ltd., Nihonbashi-muromachi, Japan

[21] Appl. No.: 16,987

[22] Filed: Mar. 2, 1979

Related U.S. Application Data

[63] Continuation of Ser. No. 819,398, Jul. 27, 1977, abandoned, which is a continuation-in-part of Ser. No. 710,385, Aug. 2, 1976, abandoned.

[30] Foreign Application Priority Data

Aug. 2, 1975 [JP] Japan ..... 50-94295
Jul. 31, 1976 [JP] Japan ..... 51-91919

[51] Int. Cl.[2] ..... G03C 5/30; G03C 1/06

[52] U.S. Cl. ..... 430/439; 430/440; 430/568; 430/581; 430/584; 430/587; 430/589; 430/592; 430/593; 430/595; 430/603; 430/617; 430/949

[58] Field of Search ..... 96/66 R, 66.3, 95, 107, 96/109, 126, 137, 140, 141

[56] References Cited

U.S. PATENT DOCUMENTS

| | | | |
|---|---|---|---|
| 3,071,465 | 1/1963 | Dersch et al. | 96/109 |
| 3,592,656 | 7/1971 | Brooks | 96/126 |
| 3,597,213 | 7/1971 | Dersch et al. | 96/109 |
| 3,708,303 | 1/1973 | Salesin | 96/107 |
| 3,765,901 | 10/1973 | Schellekens et al. | 96/140 |
| 3,832,180 | 8/1974 | Douglas | 96/66.3 |
| 3,909,268 | 9/1975 | Baldassarri et al. | 96/109 |

*Primary Examiner*—J. Travis Brown
*Attorney, Agent, or Firm*—Frishauf, Holtz, Goodman & Woodward

[57] ABSTRACT

Light-sensitive silver halide photographic materials to be treated with a hydroquinones-containing developing solution which material comprises a support and at least one hydrophilic colloidal layer coated thereon which contains silver halide grains having an average grain size of 0.05 to 1.5$\mu$, a tetrazolium compound and a sensitizing dye.

13 Claims, No Drawings

LIGHT-SENSITIVE SILVER HALIDE PHOTOGRAPHIC MATERIAL AND METHOD OF PROCESSING THEREOF

This application is a continuation application of our application Ser. No. 819,398, filed July 27, 1977, now abandoned, which, in turn, is a continuation-in-part of our application Ser. No. 710,385, filed Aug. 2, 1976, and now abandoned.

The present invention relates to a novel light-sensitive silver halide photographic material and the processing method therefor. Particularly, it relates to a novel lith type light-sensitive silver halide photographic material for obtaining a photographic image with an especially high contrast, high sharpness and high resolving power, and to the processing method therefor.

More particularly, it relates to a novel light-sensitive silver halide photographic material which is applicable advantageously to a light-sensitive silver halide photographic material with a high contrast suitable for forming a dot- or line-image on a lith (printing) light-sensitive silver halide material or a copying light-sensitive material, as well as to the processing method therefor.

It has been known to form a photographic image with an extremely high contrast by using some kind of a light-sensitive silver halide photographic material.

It has been known, for example, to obtain a high contrast image, e.g. a line- or dot-image by treating, with an alkaline hydroquinones developing solution containing sulfite ions in a very low concentration, a light-sensitive material which comprises a silver halide emulsion containing silver chloride in a high content (at least more than 50 mole %) and further containing silver iodide less than 5 mole %, the grains of which emulsion being minute (average grain size; ca. 0.3$\mu$), uniform in size and shape, and the grain size distribution thereof being narrow. The above-mentioned kind of light-sensitive silver halide material is known as the lith type light-sensitive material. In printing, there is usually required such a process as to convert a continuous gradation original to a dot image; that is a process to convert the densities of the continuous gradation to a predetermined numbered assembly of dots respectively having areas of the same densities but proportional in size to the densities of the continuous gradation. In order to carry out this, the lith type light-sensitive material is subjected to development, after photographing the original image through a cross- or contact-screen, to form the dot image on the light-sensitive material.

For this purpose there has been employed a light-sensitive silver halide photographic material containing a silver halide emulsion, the grains of which being minute and being uniform in size and shape. Even when this kind of a light-sensitive silver halide photographic material is employed, the intermediate density region (undesirable continuous gradation parts) is reproduced, beside the maximum density region and the minimum one (fog), when the material is processed with a standard black and white developing solution. The intermediate density region or the so-called flinge, undesirable for producing a printing plate and makes the dot quality worse.

There has heretofore been employed the lith type light-sensitive material also for the reproduction of a line image. For the same reason, however, there have been obtained images having at best the $\gamma$-value of 5–6 of the characteristic curve, which value is lower than 7–9 required for forming the desirable line-image, if the standard black and white developing solution is employed. In order to avoid this, there have been employed, as mentioned above, a specific developing solution called "uninfectious developing solution." It is indispensable, however, to maintain the sulfite concentration in the infectious developing solution as low as possible to obtain a high contrast image, but such the developing solution is very poor in storability because of the low concentration of the sulfite so that this have caused a big trouble in printing business. Every effort has been made, however, to improve the storability. Nevertheless, such efforts have not been so successful. As a result, an ordinary developing solution for a continuous gradation, such as Metol/hydroquinone or phenidone/hydroquinone developing solution which is excellent in the storability, is recommended for processing the light-sensitive materials. However there has been known no method capable of obtaining a dot image with a good dot quality, by using such the developing solution.

It is, therefore, the primary object of the invention to provide a novel light-sensitive silver halide photographic material and the processing method thereof to obtain a high contrast silver image.

It is another object of the invention to provide a lith type light-sensitive silver halide material being dye-sensitized and having a great development stability containing a tetrazolium compound suitable for obtaining a dot- or line-image.

It is still another object of the invention to provide a novel processing method of the above-mentioned lith type light-sensitive silver halide material to obtain a high contrast black and silver image, especially a dot- or line-image.

The inventors have found, after extensive studies to attain the above-mentioned objects, that the object can be attained by processing a lith type light-sensitive silver halide photographic material containing, in a hydrophilic colloidal layer silver halide grains having a narrow grain size distribution, a tetrazolium compound and a sensitizing dye, after exposure, with a developing solution containing a hydroquinones developing agent as a main developing agent.

In accordance with the invention, there can be formed a superior line- or dot-image, without employing the infectious development, by processing a light-sensitive silver halide photographic material having (coated on a support, at least one hydrophilic colloidal layer which comprises light-sensitive silver halide grains having an average grain size of 0.05–1.5$\mu$ and at least 75% of the total grains being within a range of 0.6–1.4 times larger than the average grain size) a tetrazolium compound and a sensitizing dye, after the image exposure, with a hydroquinones-containing developing solution.

According to a preferred embodiment of the invention, there is obtained a high contrast silver image with a development stability and a superior reproducibility of the line image by processing a light-sensitive silver halide photographic material containing silver halide grains having the above-mentioned grain size and the distribution thereof (hereinafter referred to as the silver halide of the invention), a diffusible tetrazolium compound and a sensitizing dye, after the image exposure, with a hydroquinones-containing developing solution.

According to another preferred embodiment of the invention, there is obtained a dot-image (half tone image) with a superior development stability and a superior dot quality by developing a light-sensitive silver halide photographic material containing the silver halilde of the invention and a non-diffusible tetrazolium compound and a sensitizing dye, after the image exposure through a contact screen, with the Metol/hydroquinone developing solution (hereinafter referred to as the MQ developing solution) or with the phenidone-hydroquinone developing solution (hereinafter referred to as the PQ developing solution) which are famous and polular for the black and white developing solution.

It can not be expected from heretofore known techniques that the high contrast line- or dot-image could be obtained without employing the infectious developing solution.

As explained above, the tetrazolium compounds include non-diffusible and diffusible ones. The term "non-diffusible tetrazolium compound" means a compound which does not dissolve from the light-sensitive material to the developing solution during the development. In other words, the compound does not dissolve in a concentration of several %, preferably not more than 2%, when a gelatin layer containing the compound is dipped for 10 minutes in an aqueous solution at 20°–40° C. having the same ion strength and pH-value as those of the developing solution.

The representative tetrazolium compounds employed in the invention include the following compounds represented by the general formulae:

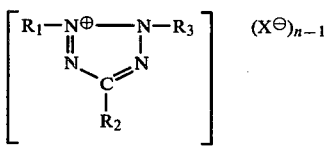

$(X^{\ominus})_{n-1}$ (I)

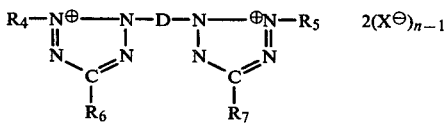

$2(X^{\ominus})_{n-1}$ (II)

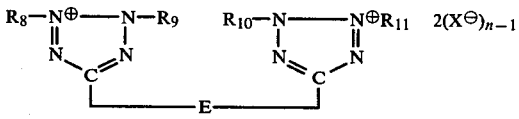

$2(X^{\ominus})_{n-1}$ (III)

In the above formulae, $R_1$, $R_3$, $R_4$, $R_5$, $R_8$, $R_9$, $R_{10}$ and $R_{11}$ each represent a group selected from an aryl group such as a phenyl group (e.g. phenyl, tolyl, hydroxyphenyl, carboxyphenyl, aminophenyl or mercaptophenyl, carboxyethyl, nitrophenyl, ethoxyphenyl, iodophenyl, methoxyphenyl, cyanophenyl, acetoamidophenyl, etc.), a naphthyl group (e.g. an α-naphtyl, β-naphtyl, hydroxynaphthyl, carboxynaphthyl or aminonaphthyl, etc.); and a heterocyclic group (e.g. a thiadiazolyl, benzothiadiazolyl, oxazolyl, pyrimidinyl or pyridyl group, 2,5-dimethyl thiazolyl, etc.); the groups can advantageously contain an electron sharing group capable of forming a metal chelate or a complex such as primary, secondary, tertiary amino, oxime, thioether, keto, thioketo, hydroxyl, mercapto, carboxyl, sulfo, phospho, and alkoxyl; $R_2$, $R_6$ and $R_7$ represent each a group selected from an aryl group such as a phenyl group and a naphthyl group, a heterocyclic group, an alkyl group (e.g. methyl, ethyl, propyl, butyl, mercaptomethyl or mercaptoethyl and a carboxyalkyl group such as methoxycarbonyl or ethoxycarbonyl), hydroxyl, carboxyl or the salt thereof, an amino group (e.g. amino, ethylamino or anilino), mercapto, nitro and hydrogen; D represents a divalent aromatic group; E represents a group selected from an alkylene group, an arylene group and an aralkylene group; X is anion; and n is 1 or 2, provided that the compound forms an intramolecular salt when n is 1.

In the above formula, the divalent aromatic group for E is preferably an arylene group (e.g. phenylene, alkoxy-substituted phenylene such as methoxy-substituted phenylene, naphtylene diphenylene, etc.) or a divalent aromatic heterocyclic group.

The following are typical examples of the cationic moieties of the tetrazolium compounds represented by the formula but not intended to limit the tetrazolium compound thereof.

(1) 2-(Benzothiazol-2-yl)-3-phenyl-5-dodecyl-2H-tetrazolium
(2) 2,3-Diphenyl-5-(4-t-octyloxyphenyl)-2H-tetrazolium
(3) 2,3,5-Triphenyl-2H-tetrazolium
(4) 2,3,5-Tri(p-carboxyethylphenyl)-2H-tetrazolium
(5) 2-(Benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4-Cyanophenyl)-2,3-diphenyl-2H-tetrazolium
(23) 3-(p-Acetamidophenyl)-2,5-diphenyl-2H-tetrazolium
(24) 5-Acetyl-2,3-diphenyl-2H-tetrazolium
(25) 5-(Fur-2-yl)-2,3-diphenyl-2H-tetrazolium
(26) 5-(Thien-2-yl)-2,3-diphenyl-2H-tetrazolium
(27) 2,3-Diphenyl-5-(pyrid-4-yl)-2H-tetrazolium
(28) 2,3-Diphenyl-5-(quinol-2-yl)-2H-tetrazolium
(29) 2,3-Diphenyl-5-(benzoxazol-2-yl)-2H-tetrazolium
(30) 2,3-Diphenyl-5-nitro-2H-tetrazolium
(31) 2,2',3,3'-Tetraphenyl-5,5'-1,4-butylene-di-(2H-tetrazolium)
(32) 2,2',3,3'-Tetraphenyl-5,5'-p-phenylene-di-(2H-tetrazolium)
(33) 2-(4,5-Dimethylthiazol-2-yl)-3,5-diphenyl-2H-tetrazolium
(34) 3,5-Diphenyl-2-(triazin-2-yl)-2H-tetrazolium

(35) 2-(Benzothiazol-2-yl)-3-(4-methoxyphenyl)-5-phenyl-2H-tetrazolium
(36) 2,5-Diphenyl-3-α-naphthyl-2H-tetrazolium
(37) 3,3'-(3,3'-Dimethoxy-4,4'-diphenylene)-2,2',5,5'-tetraphenyl-di-(2H-tetrazolium)

As the anion moiety, there can be mentioned, e.g. a halogen ion, a thiosulfate anion, a sulfate anion, a thiocyanate anion, an alkylsulfate anion, a nitrate anion, an acetate anion, a lower alkyl benzenesulfonate anion for the diffusible tetrazolium compound and higher alkylbenzene-sulfonate anion such as p-dodecylbenzenesulfonate anion, a higher alkylsulfate anion such as laurylsulfate anion, a dialkylsulfosuccinate anion such as di-2-ethylhexylsulfosuccinate anion, a polyether alcohol sulfate anion such as cetylpolyethenoxysulfate anion, a higher fatty acid anion such as stearic acid anion, and a polymer having acid radicals such as polyacrylate anion for the non-diffusible tetraozlium compound.

Most typical examples of the compounds of the invention are as follow:

[1] Diffusible tetrazolium compound (1) 2,3,5-Triphenyl-2H-tetrazolium chloride
(2) 2,3,5-Tri(p-carboxyethylphenyl)-2H-tetrazolium iodide
(3) 2-(Benzothiazol-2-yl)-3-phenyl-5-(o-chlorophenyl)-2H-tetrazolium bromide
(4) 2,3-Diphenyl-2H-tetrazolium thiosulfate
(5) 2,3-Diphenyl-5-methyl-2H-tetrazolium chloride
(6) 3-(p-Hydroxyphenyl)-5-methyl-2-phenyl-2H-tetrazolium sulfate
(7) 2,3-Diphenyl-5-ethyl-2H-tetrazolium chloride
(8) 2,3-Diphenyl-5-n-hexyl-2H-tetrazolium chloride
(9) 5-Cyano-2,3-diphenyl-2H-tetrazolium thiocyanate
(10) 2-(Benzothiazol-2-yl)-5-phenyl-3-(4-tolyl)-2H-tetrazolium chloride
(11) 2-(Benzothiazol-2-yl)-5-(4-chlorophenyl)-3-(4-nitrophenyl)-2H-tetrazolium chloride
(12) 5-Ethoxycarbonyl-2,3-di(3-nitrophenyl)-2H-tetrazolium bromide
(13) 5-Acetyl-2,3-di(p-ethoxyphenyl)-2H-tetrazolium chloride
(14) 2,5-Diphenyl-3-(p-tolyl)-2H-tetrazolium methylsulfate
(15) 2,5-Diphenyl-3-(p-iodophenyl)-2H-tetrazolium chloride
(16) 2,3-Diphenyl-5-(p-diphenyl)-2H-tetrazolium chloride
(17) 5-(p-Bromophenyl)-2-phenyl-3-(2,4,6-trichlorophenyl)-2H-tetrazolium chloride
(18) 3-(p-Hydroxyphenyl)-5-methyl-2-phenyl-2H-tetrazolium chloride
(19) 5-(3,4-Dimethoxyphenyl)-3-(2-ethoxyphenyl)-2-(4-methoxypheny)-2H-tetrazolium chloride
(20) 5-(4-Cyanophenyl)-2,3-diphenyl-2H-tetrazolium chloride
(21) 3-(p-Acetamidophenyl)-2,5-diphenyl-2H-tetrazolium chloride
(22) 5-Acetyl-2,3-diphenyl-2H-tetrazolium chloride
(23) 5-(Fur-2-yl)-2,3-diphenyl-2H-tetrazolium chloride
(24) 5-(Thien-2-yl)-2,3-diphenyl-2H-tetrazolium chloride
(25) 2,3-Diphenyl-5-(pyrid-4-yl)-2H-tetrazolium nitrate
(26) 2,3-Diphenyl-5-(quinol-2-yl)-2H-tetrazolium chloride
(27) 2,3-Diphenyl-5-(benzoxazol-2-yl)-2H-tetrazolium chloride
(28) 2,3-Diphenyl-5-nitro-2H-tetrazolium methylsulfate
(29) 2,2',3,3'-Tetraphenyl-5,5'-1,4-butylene-di-(2H-tetrazolium chloride)
(30) 2,2',3,3'-Tetraphenyl-5,5'-p-phenylene-di-(2H-tetrazolium chloride)
(31) 2-(4,5-Dimethylthiazol-2-yl)-3,5-diphenyl-2H-tetrazolium chloride
(32) 3,5-Diphenyl-2-(triazin-2-yl)-2H-tetrazolium sulfate
(33) 2-(Benzothiazol-2-yl)-3-(4-methoxyphenyl)-5-phenyl-2H-tetrazolium chloride
(34) 2,5-Diphenyl-3-α-napthyl-2H-tetrazolium chloride
(35) 3,3'-(3,3'-Dimethoxy-4,4'-diphenylene)-2,2',5,5'-tetraphenyl-di-(2H-tetrazolium chloride)
(36) 5-(3-Methoxyphenyl)-3-(3-trifluoromethylphenyl)-2-phenyl-2H-tetrazolium acetate

[2] Non diffusible tetrazolium compound

(37) 2-(Benzothiazol-2-yl)-3-phenyl-5-dodecyl-2H-tetrazolium bromide
(38) 2,3-Diphenyl-5-(4-t-octyloxyphenyl)-2H-tetrazolium chloride
(39) 2,3,5-Triphenyl-2H-tetrazolium diethylhexylsuccinate sulfonate
(40) 2,3,5-Tri(p-carboxyethylphenyl)-2H-tetrazolium p-dodecylbenzenesulfonate
(41) 2-(Benzothiazol-2-yl)-3-phenyl-5-(o-chlorophenyl)-2H-tetrazolium diethylhexylsuccinate sulfonate
(42) 2,3-Diphenyl-2H-tetrazolium p-octylbenzenesulfonate
(43) 2,3-Diphenyl-5-methyl-2H-tetrazolium laurylsulfate
(44) 3-(p-Hydroxyphenyl)-5-methyl-2-phenyl-2H-tetrazolium isopropylnaphthalenesulfonate
(45) 2,3-Diphenyl-5-ethyl-2H-tetrazolium diethylhexylsulfosuccinate
(46) 2,3-Diphenyl-5-n-hexyl-2H-tetrazolium cetylpolyethenoxysulfate
(47) 5-Cyano-2,3-diphenyl-2H-tetrazolium polyacrylate
(48) 2-(Benzothiazol-2-yl)-5-phenyl-3-(4-tolyl)-2H-tetrazolium diethylhexylsuccinate sulfonate
(49) 2-(Benzothiazol-2-yl)-5-(4-chlorophenyl)-3-(4-nitrophenyl)-2H-tetrazolium diethylhexylsuccinate sulfonate
(50) 5-Ethoxycarbonyl-2,3-di(3-nitrophenyl)-2H-tetrazolium diethylhexylsuccinate sulfonate
(51) 5-Acetyl-2,3-di(p-ethoxyphenyl)-2H-tetrazolium diethylhexylsuccinate sulfonate
(52) 2,5-Diphenyl-3-(p-tolyl)-2H-tetrazolium p-octylbenzenesulfonate
(53) 2,5-Diphenyl-3-(p-iodophenyl)-2H-tetrazolium p-octylbenzenesulfonate
(54) 2,3-Diphenyl-5-(p-diphenyl)-2H-tetrazolium p-octylbenzenesulfonate
(55) 5-(p-Bromophenyl)-2-phenyl-3-(2,4,6-trichlorophenyl)-2H-tetrazolium isopropylnaphthalenesulfonate
(56) 3-(p-Hydroxyphenyl)-5-(p-nitrophenyl)-2-phenyl-2H-tetrazolium diethylhexylsuccinate sulfonate
(57) 5-(3,4-Dimethoxyphenyl)-3-(2-ethoxyphenyl)-2-(4-methoxyphenyl)-2H-tetrazolium diethylhexylsuccinate sulfonate
(58) 5-(4-Cyanophenyl)-2,3-diphenyl-2H-tetrazolium diethylhexylsuccinate sulfonate
(59) 3-(p-Acetamidophenyl)-2,5-diphenyl-2H-tetrazolium laurylsulfate
(60) 5-Acetyl-2,3-diphenyl-2H-tetrazolium diethylhexylsuccinate sulfonate
(61) 5-(Fur-2-yl)-2,3-diphenyl-2H-tetrazolium diethylhexylsuccinate sulfonate

(62) 5-(Thien-2-yl)-2,3-diphenyl-2H-tetrazolium diethylhexylsuccinate sulfonate

(63) 2,3-Diphenyl-5-(pyrid-4-yl)-2H-tetrazolium diethylhexylsuccinate sulfonate

(64) 2,3-Diphenyl-5-(quinol-2-yl)-2H-tetrazolium diethylhexylsuccinate sulfonate

(65) 2,3-Diphenyl-5-(benzoxazol-2-yl)-2H-tetrazolium diethylhexylsuccinate sulfonate

(66) 2,4-Diphenyl-5-nitro-2H-tetrazolium polyacrylate

(67) 2,2',3,3'-Tetraphenyl-5,5'-1,4-butylene-di-(2H-tetrazolium) laurylsulfate

(68) 2,2',3,3'-Tetraphenyl-5,5'-p-phenylene-di-(2H-tetrazolium) cetylpolyethenoxysulfate

(69) 2-(4,5-Dimethylthiazol-2-yl)-3,5-diphenyl-2H-tetrazolium polyacrylate

(70) 3,5-Diphenyl-b 2-(triazin-2-yl)-2H-tetrazolium stearate

(71) 2-(Benzothiazol-2-yl)-3-(4-methoxyphenyl)-5-phenyl-2H-tetrazolium di-ethylhexylsulfosuccinate p0

(72) 2,5-Diphenyl-3-α-naphtyl-2H-tetrazolium dodecylsulfate

(73) 3,3'-(3,3'-Dimethoxy-4,4'-diphenylene)-2,2'5,5'-tetraphenyl-di-(2'-tetrazolium polyacrylate)

(74) 5-(3-Methyloxyphenyl)-3-(3-trifluoromethylphenyl)-2-phenyl-tetrazolium isopropylnaphthalenesulfonate

(75) 2,3,5-Triphenyl-2H-tetrazolium isopropylnaphthalenesulfonate

The non-diffusible or diffusible tetrazolium compounds according to the invention are thus synthesized by an optional selection of the anionic and cationic moieties. The non-diffusible compounds, e.g. 2,3,5-triphenyl-2H-tetrazolium dioctyl-succinatesulfonate may dispersed into a gelatin solution by mixing the respective soluble tetrazolium salt and the gelatin first to disperse them in the gelatin solution and then by that optimum anion is admixed thereto thereby to obtain the gelatin solution dispersed with the non-diffusible, tetrazolium compound as specifically mentioned in working Examples set forth lates.

Alternatively, crystals of the non-diffusible tetrazolium compound purely synthesized may be dissolved in a suitable solvent such as dimethylsulfoxide and then dispersed in the gelatin solution.

When the dispersion is not sufficiently homogeneous, good results may be obtained by exposing the emulsion dispersion to an ultrasonic wave or by use of a suitable homogenizer such as Manton-Gaulin homogenizer.

As mentioned above, the tetrazolium compounds of this invention may be used both in diffusible and non-diffusible forms, when the silver halide of this invention is employed. However, the higher contrast image may be obtained by employing the non-diffusible tetrazolium compounds. Accordingly, it is advantageous to employ the non-diffusible tetrazolium compound when an especially superior dot quality is required.

On the other hand, the use of too much high contrast light-sensitive material sometimes brings about not sufficient reproduction of the line-image, particularly those of fine letters and lines. In this case, an image with more superior quality may be obtained by the use of the diffusible tetrazolium compounds.

According to a preferred embodiment of the invention, the tetrazolium compound of the invention is incorporated into a silver halide emulsion layer.

According to another preferred embodiment of the invention, the compound is incorporated in a layer adjacent directly (or a layer adjacent to said adjacent layer) to the layer containing the silver halide emulsion.

The above-mentioned compounds of the invention may preferably be employed in an amount of 0.0001–10 mole, more preferably 0.001–1 mole, per mole of the silver halide contained in the light-sensitive silver halide photographic material of the invention.

The sensitizing dyes used in this invention mean those which can extend a sensitive wave length range of the silver halide outside of its inherent sensitive wave length. Sensitizing dyes used for this invention cover those such as cyanines, merocyanines, hemicyanines, oxonols, hemioxonols or mixed merocyanines. Such dyes are described in e.g. "The cyanine dye and related compounds" by F. M. Hamer and "The Theory of Photographic Process", Third edition by C. E. Kenneth Mees and T. H. James.

Preferred sensitizing dyes of this invention may be concretely expressed by the general formulae [I]–[VII];

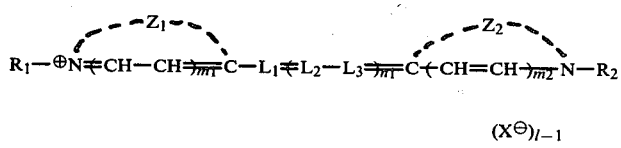

[I]

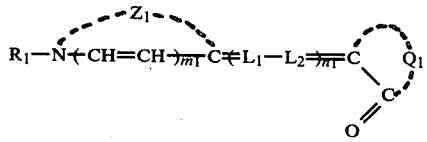

[II]

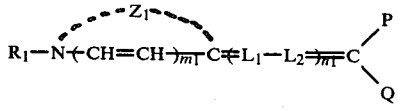

[III]

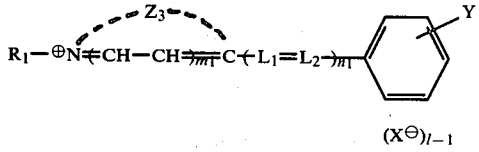

[IV]

-continued

[V]

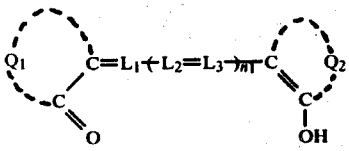

[VI]

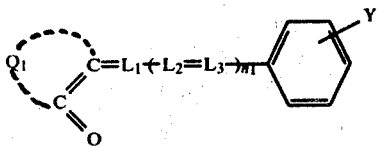

[VII]

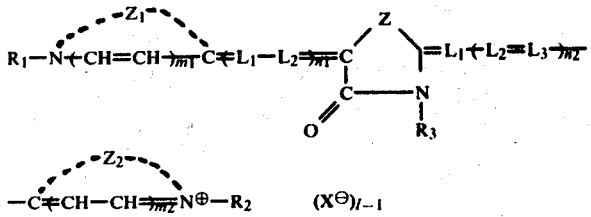

In which $R_1$, $R_2$ and $R_3$ each represent an alkyl group (e.g. methyl, ethyl, propyl, butyl and substituted alkyl such as chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfatepropyl, allyl, benzyl, etc.) or an aryl group (e.g. phenyl, carboxyphenyl, sulfophenyl, etc.); $L_1$, $L_2$ and $L_3$ each represent a methynyl group including substituted methynyl (e.g. —CH=, —C($CH_3$)=, —C($C_2H_5$)=, —C($CH_2COOH$)=,

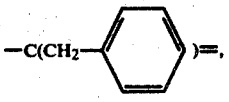

—C($C_6H_5$)=, —C($C_6H_4COOH$)=, etc.); $Z_1$, $Z_2$ and $Z_3$ each represent an atom or atom groups necessary for forming a 5 to 6 membered heterocyclic ring (e.g. thiazoline, oxazoline, selenazoline, thiazole, selenazole, oxazole, benzothiazole, benzooxazole, benzoquinazole, benzoimidazole, 3,3-dialkyl-indolenine, naphthothiazole, naphthooxazole, naphthoselenazole, thienothiazole, 2-pyridine, 4-pyridine, 2-quinoline, 4-quinoline nucleus etc.); P and Q each represent cyano, —$COOR_4$, —$COR_4$ or —$SO_2R_4$ in which $R_4$ represents an alkyl group; further $Q_1$ and $Q_2$ each represent an atomic group necessary for forming a thiooxazolone ring, a pyrazolone ring, an oxyindole ring, a barbituric acid, a 2-thiobarbituric acid, a 2,4-oxazolidinedione ring, a 2,4-thiazolidinedione ring, a 2,4-imidazolidinedione ring, a 2-thio-2,4-oxazolidinedione ring, a 2-thio-2,4-thiazolidinedione ring, a 2-thio-2,4-selenazolidinedione ring, a 2-thio-2,5-thiazolidinedione ring, a 2-thiohydantoine ring, a 4-oxazolinone ring, a 4-thiazolinone ring or a 4-imidazoline ring, etc., the groups or rings including the substituted; Y represents hydrogen, amino, alkylamino preferably having 1 to 4 carbon atoms (e.g. ethylamino, etc.), dialkylamino preferably having 2 to 8 carbon atoms (e.g. dimethylamino, etc.), halogen (e.g. chlorine or bromine atom, etc.) or an alkyl group preferably having 1 to 4 carbon atoms (e.g. methyl, etc.); $m_1$ and $m_2$ each represent zero or 1; $n_1$ and $n_2$ each represent 0 or 2; X represents an acid anion (e.g. $Cl^{\ominus}$, $Br^{\ominus}$, $I^{\ominus}$, $ClO_4^{\ominus}$,

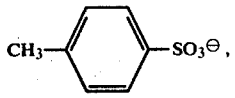

$CH_3SO_4^{\ominus}$, $C_2H_5SO_4^{\ominus}$, etc.); l represents 1 or 2 and an intramolecular salt is formed and when l represents 1.

Typical sensitizing dyes having the above general formulae according to this invention will be exemplified below but this is not intended to limit these dyes:

1.

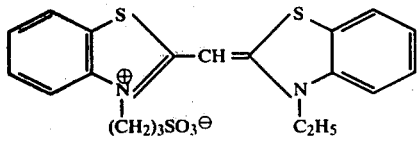

2.

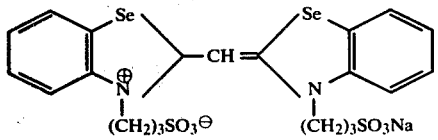

3.

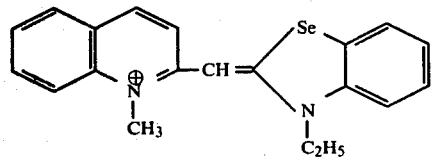

4.

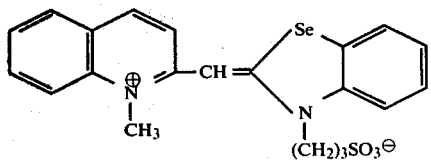

-continued
5.
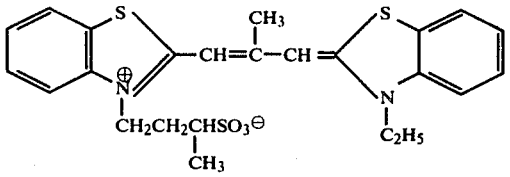
6.
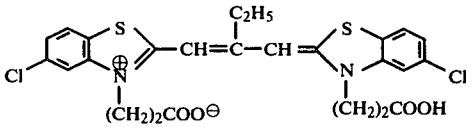
7.
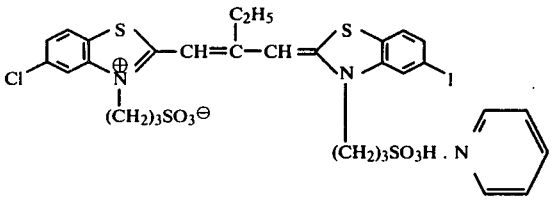
8.
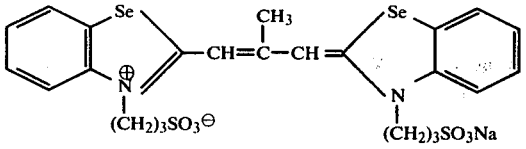
9.
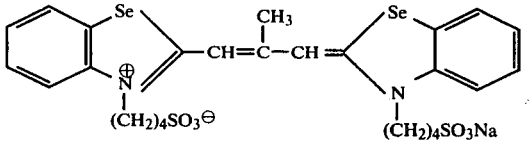
10.
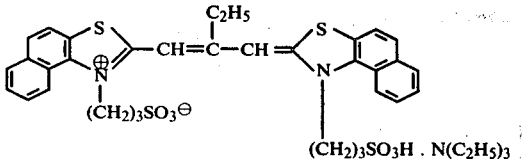
11.
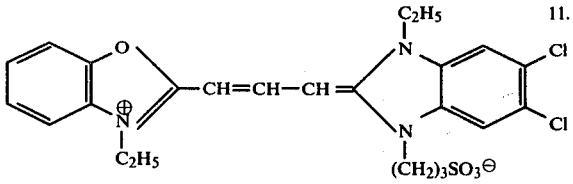
12.
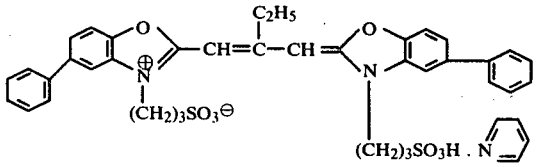
13.
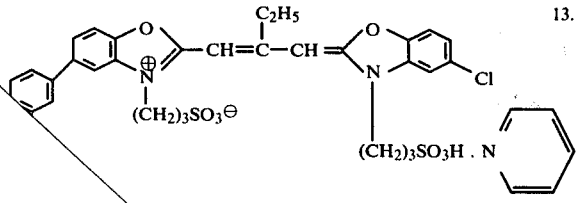
-continued
14.
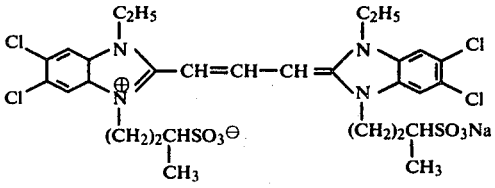
15.
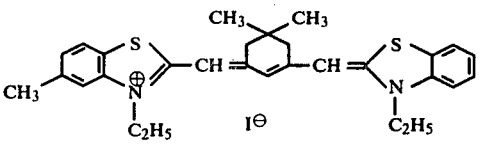
16.
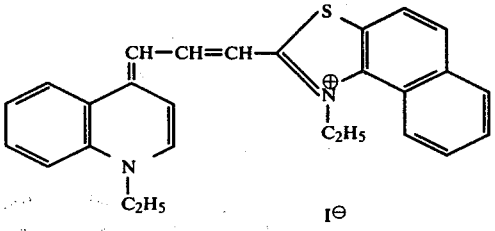
17.
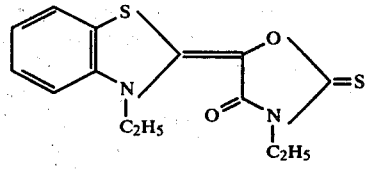
18.
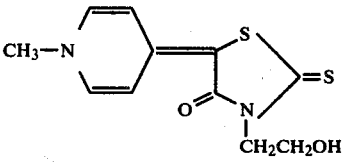
19.
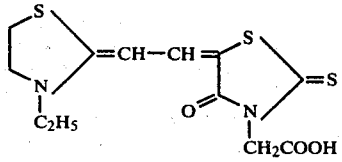
20.
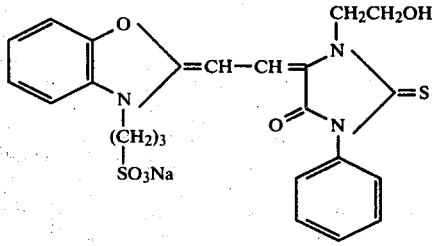
21.
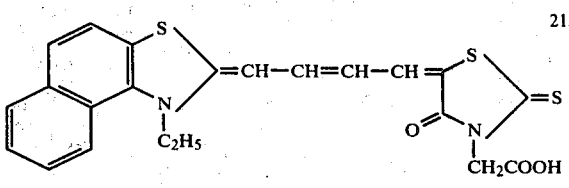

-continued

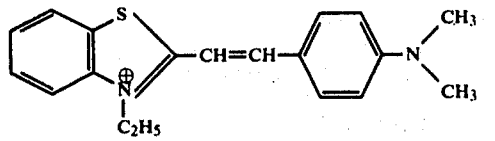

22.

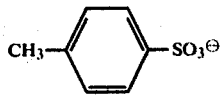

23.

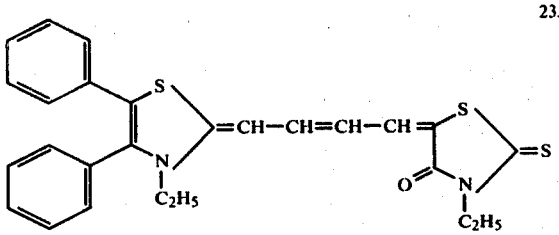

24.

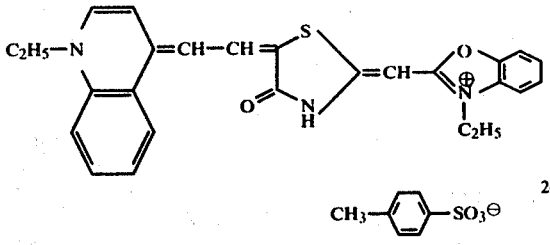

25.

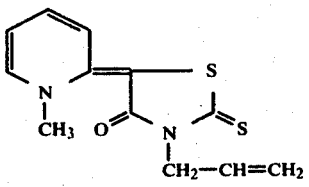

26.

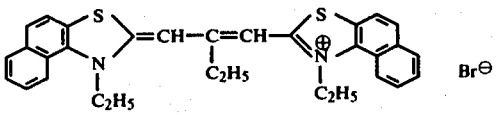

27.

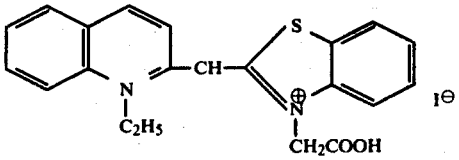

28.

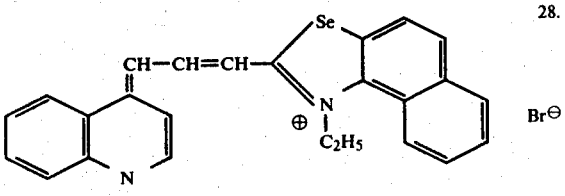

29.

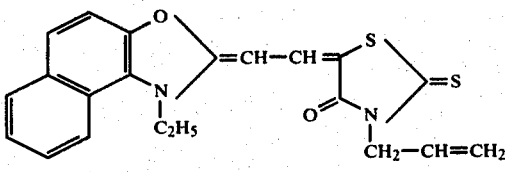

These compounds of this invention can readily be synthesized by the methods described in e.g. U.S. Pat. Nos. 2,213,995, 3,711,288, 2,503,776, 3,576,641, 2,945,763, 3,625,698, etc..

These sensitizing dyes according to this invention may be incorporated into a hydrophilic colloid containing the silver halide of this invention and a tetrazolium compound by dissolving them in water or an organic solvent such as methanol and ethanol, which is miscible with water in any ratio and they can be used in single or in combination of two or more.

The incorporation of the sensitizing dyes into said hydrophilic colloid may be any time during the preparation of the silver halide emulsion, but is preferred to be generally after the completion of the second ripening.

The sensitizing dye can be used in an amount of 10 mg to 1 g, preferably 30 to 300 mg, per one mole of silver halide.

The light-sensitive silver halide photographic material of this invention, in which the sensitizing dye is incorporated, can shown not only an excellent stability during development but also can be sensitized in any preferred spectrum range. In addition, a super sensitization can be expected by use of a combination of two or more sensitizing dyes in general.

As the silver halide employed for the light-sensitive silver halide photographic material of the invention, there can be included silver halide used for the conventional silver halide photographic materials, e.g. silver bromide, silver chlorobromide, silver iodobromide, silver chloroiodobromide or silver chloride and the like. The average grain size of the silver halide in the invention is 0.05–1.5μ, preferably 0.1–0.8μ, and at least 75% grains of the total grains are within a range of 0.6–1.4, preferably 0.7–1.3 times larger than the average grain size. Furthermore, the silver halide comprises silver chlorobromide or chloroiodobromide containing at least 50 mole % silver chloride. The silver halide of the invention having the above-mentioned average grain size and the distribution thereof may be prepared by any known method described, e.g. in U.S. Pat. Nos. 2,592,250, 3,276,877, 3,317,322, 2,222,264, 3,320,069 and 3,206,313 and in Journal of Photographic Science 12(5), 242–251 (1964). Silver halides prepared by other methods may also be employed in mixture.

According to the most preferred concrete embodiment of the invention, the silver halide of the invention is silver chloroiodobromide or chlorobromide having an average grain size of 0.1–0.5μ and at least 80% grains of the total grains being within a range of 0.7–1.3 times larger than the average grain size.

The silver halide emulsion of the invention may be sensitized with various kinds of chemical sensitizers. As the sensitizer, there can be mentioned, for example, activated gelatin, sulfur sensitizers (e.g. sodium thiosulfate, aryl thiocarbamide, thiourea or aryl isocyanate, etc.), selenium sensitizers (e.g. N,N-dimethylserenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-aurosulfobenzothiazole methylchloride, ammonium chloropalladate, potassium chloroplatinate and sodium chloropalladite. The sensitizer may be employed alone, or mixed together. Ammonium thiocyanate may be auxiliarily employed when a gold sensitizer is employed.

The silver halide emulsion of the invention may preferably be stabilized with 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo-(1,5-a)pyrimidine, 7-hydroxy-s-triazolo(1,5-a)pyrimidine, 5-methyl-6-bromo-7-hydroxy-s-triazolo(1,5-a)pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Such stabilizers are described in, e.g. U.S. Pat. Nos. 2,444,607, 2,716,062, 3,512,982, 3,342,596, 3,726,686 and 3,717,465, British Pat. No. 1,363,921. Furthermore, the silver halide emulsion of the invention may contain a latent image stabilizer such as a sulfur-containing amino acid, or a gradation-adjusting agent such as a cadmium or rhodium salt, described in, e.g. British Pat. No. 1,343,904 and U.S. Pat. No. 3,821,295.

It has been known in, e.g. British Pat. No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount of addition and the narrow allowable range thereof of the salt, and thus makes it difficult to produce stable photographic material. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the body of sea animals. As a result of interest in public health and in the maintenance of normal ecological balance in view of the toxicity of rare metals, including cadmium mentioned above, the inventors have reached the invention relating to a novel method to obtain a light-sensitive material with sufficiently high contrast, even in no use of such harmful metals when the above-mentioned silver halide, tetrazolium compound and sensitizing dye of the invention are incorporated into the hydrophilic colloidal layer.

The hydrophilic colloid advantageously employed in the invention is gelatin. As other hydrophilic colloids than gelatin, are mentioned, e.g. colloidal albumin, agar, gum arabic, arginic acid, hydrolyzed cellulose acetate, acrylamide, imidated polyamide, polyvinyl alcohol, hydrolized polyvinyl acetate, water-soluble polymer described in, e.g. British Pat. No. 523,661, U.S. Pat. Nos. 3,847,620, 3,655,389 and 3,341,332, gelatin derivatives such as phenylcarbamyl-, acylated- or phthalated-gelatin described in, e.g. U.S. Pat. Nos. 2,614,928 and 2,525,753, or graft-polymerized monomers on gelatin having the ethylene group and being capable of polymerization, such as acrylic acid and the ester thereof, styrene, a methacrylic acid and the ester thereof, described in, e.g. U.S. Pat. Nos. 2,548,520 and 2,831,767. Such hydrophilic colloids may also be applied to a layer containing no silver halide, e.g. an antihalation layer, a protective layer or a intermediate layer.

The light-sensitive silver halide material of the invention may be prepared by coating the above-mentioned layer containing the silver halide, the sensitizing dye and the tetrazolium compound of the invention on a suitable photographic support. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the light-sensitive photographic material is used.

As mentioned above, the light-sensitive silver halide photographic material of the invention comprise at least one hydrophilic colloidal layer, coated on a support, containing a silver halide of the invention and a sensitizing dye and a tetrazolium compound.

It is preferable in the light-sensitive material of the invention that a protective layer having a suitable thickness is coated. The protective layer is advantageously a gelatin layer, the thickness of which is preferably 0.1–10$\mu$, more preferably 0.8–2.0$\mu$.

The presence of the protective layer may act effectively on the stability of the image quality and of the developing process in this invention. This is presumed because, the protective layer may have a function to control adequately the infiltration rate of the hydroquinone/Metol or phenidone from the processing solution into the light-sensitive material, or the diffusion rate of the tetrazolium compound within the light-sensitive material or therefrom to the processing solution. This effect is remarkable when the tetrazolium compound of the invention is employed. The effect is not so remarkable when other oxidizing agents than the tetrazolium compound, described in, e.g. Japanese Patent Application No. 50-94295 are employed.

Various kinds of photographic additives may optionally be added to the above-mentioned hydrophilic colloid of the invention, as far as they do not impair the effect of the invention. As the additives, there can be used, e.g. a gelatin plasticizer, a hardening agent, a surface active agent, a image stabilizer, an ultraviolet absorber, an anthistaining agent, a pH adjuster, an antioxidant, an antistatic agent, a viscosity-increasing agent, a granularity improving agent, a dye, a mordant, a brightening agent, a development regulator, a matting agent, and the like.

Among the additives mentioned above, the following may particularly and preferably be employed: viscosity-increasing agents and plasticizers, described in U.S. Pat. Nos. 2,960,404 and 3,767,410, 3,659,956 and 3,692,753, e.g. a styrene/sodium maleate copolymer and dextran sulfate, etc.; hardening agents of an aldehyde, epoxy, ethyleneimine, active halogen, vinylsulfone, isocyanate, sulfonic acid ester, carbodiimide, mucochloric acid or acryloyls, etc.; image stabilizers, e.g. 6,6'-butylidene-bis(2-t-butyl-4-methylphenol) and 4,4'-methylene-bis(2,6-di-t-butylphenol), etc.; ultraviolet absorbers, described in, e.g. U.S. Pat. No. 3,253,921, British Pat. No. 1,309,349, U.S. Pat. Nos. 3,533,794 and 3,707,375 and British Pat. No. 1,287,720, particularly 2-(2-hydroxy-5-t-butylphenyl)benzotriazole, 2-(2-hydroxy-3,5-di-t-butylphenyl)benzotriazole, 2-(2-hydroxy-3-t-butyl-5-butylphenyl)-5-chlorobenzotriazole and 2-(2-hydroxy-3,5-di-t-butylphenyl)-5-chlorobenzotriazole; surface active agents for coating aids, emulsifiers, infiltration-improving agents for processing solution, defoamers, or agents for controlling various physical properties of the light-sensitive material, described in, e.g. U.S. Pat. Nos. 3,026,202 and 3,514,293, British Pat. Nos. 548,532 and 1,216,389, U.S. Pat. No. 3,726,683, including anionic, cationic, nonionic and amphoteric compounds; mordants described in, e.g. U.S. Pat. Nos. 2,113,381 and 2,548,564; antistaining agents described in, e.g. U.S. Pat. Nos. 2,360,210, 2,728,659, 2,732,300 and 3,770,453, particularly 2-methyl-5-hexadecylhydroquinone, 2-methyl-5-sec-octadecylhydroquinone and 2,5-di-t-octylhydroquinone, etc.; antistatic agents described in, e.g. U.S. Pat. Nos. 2,882,157, 2,972,535 and 3,573,093 and British Pat. No. 1,378,584 and U.S. Pat. No. 3,549,369, 3,704,128 and 3,663,230; matting agents described in, e.g. U.S. Pat. Nos. 2,992,101 and 2,956,884, British Pat. No. 1,221,980 and British Pat. No. 1,307,373, particularly silica gel having a grain size of 0.5–20μ and polymethylmethacrylate having a grain size of 0.5–20μ; developing promotors, e.g. benzyl alcohol and a polyoxyethylene series compound which may be added in the processing bath.

In accordance with the process of the invention, there is obtained a high contrast silver image. The invention is therefore applicable to various fields wherein a high contrast black and white recording is required. The light-sensitive material of the invention is, for example, applied preferably to a printing- or micro- sensitive material. The process of the invention for forming a lith type photographic image has superior characteristics which no conventional processes have reached yet. It is not necessarily elucidated why the high contrast silver image may be obtained according to the process of the invention. It is presumed that the semiquinone produced by oxidation of hydroquinone in the developing solution by the tetrazolium compound may be accumulated in an abnormally high concentration near the developed silver. It is said, in general, that the so-called "infectious phenomenon" does not take place due to instantaneous removal of the semiquinone or quinones by sulfonation when the sulfite ions are in a high concentration in the developing solution. Whereas, in the present process, it is presumed as if the infectious development takes place at the position of the exposed silver halide in the gelatin layer due to predominant supply of the semiquinone.

It is accordingly essential in the process of the invention to treat with a developing solution containing a hydroquinones developing agent. The lith type developing solution (infectious developing solution), however, is not essentially required as far as the solution is of hydroquinones by which high contrast lith type silver image may sufficiently be obtained even in the presence of sulfite ion in a high concentration. The process of the invention differs apparently from the conventional processes in that no conventional lith type developing solution which contains hydroquinone, alkali, alkali metal bromide, sulfite ion in low concentration, and as a preserver a condensation product of formaldehyde/sodium bisulfite or carbonylbissulfite amine is needed, although the use of such components may of course be possible.

As the hydroquinone type developing agents employed in the invention are mentioned, e.g. hydroquinone, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 2,5-dihydroxyacetophenone, 2,5-diethylhydroquinone, 2,5-di-p-phenethylhydroquinone, 2,5-dibenzoylaminohydroquinone, and the like.

The developing solution containing the hydroquinones developing agent employed in the invention includes not only the so-called lith type developing agent but also the gradient MQ and PQ developing solution, the latters of which are advantageously employed in the invention because of the easiness of preparation and superior preservability. Among these developing solutions, those which show the superadditivity are preferred. For example, the developing agents and the additives therefor described in "The Theory of Photographic Process", Third Edition, pp 374–378 (1966) are advantageously employed. A preserver like sulfite salts such as sodium sulfite, potassium sulfite or ammonium sulfite may jointly be employed in the developing solution used in the invention without impairing the effect of the invention; and this is another characteristic of the invention. The adjustment of pH and giving a buffer function with an alkali hydroxide, alkali carbonate or amine, or addition of inorganic development retarder such as potassium bromide or of organic development retarder such as benzotriazole may optionally be carried out as in the standard black and white developing solution.

In the invention the phrase "treat with a developing solution containing hydroquinones developing agent" means to carry out development of the exposed material of the invention with the developing solution which satisfies the above-mentioned conditions, and various modes may be included therein. For example, the temperature at which development is carried out is preferably below 50° C., more preferably around 30° C., and the time required for development is generally within 30 minutes, more preferably within 5 minutes, by which good results are obtained, in general.

After the development, the subsequent processes such as washing, stopping, stabilizing and fixing are carried out. If necessary, processes like prehardening and neutralization and the like may be adopted, but they may optionally be omitted. The processes may be carried out either by the so-called manual treatment like a bath- or tray-development or by the mechanical treatment like a roller- or hanger-development. According to a preferred embodiment of the invention, the processing solution in the bath development was more than 20 times more stabler over long period than the conventional lith type developing solution. Especially, when the known particular developing solution containing sulfite ion in an extremely low concentration is employed in order to improve the dot quality of the lith type light-sensitive material, it became of no use for several hours. While, according to a preferred method of the invention, the processing solution could be stably employed after one month has passed, and the dot quality using the solution was then comparable to that using a newly prepared solution.

Furthermore, addition of a contrast agent often used for the conventional high contrast developing solution to the developing solution employed in the invention gives no undesirable influence on the photographic quality.

As can be clearly understood by the explanations given above, the invention relates to a novel light-sensitive silver halide photographic material and the processing method thereof which may obtain a superior stable line- or dot-image by processing the light-sensitive silver halide photographic material comprising a sensitizing dye, a tetrazolium salt and a silver halide having a narrow grain size distribution, with a developing solution containing hydroquinone, using no infectious developing solution.

According to the process of the invention, there is obtained a stable high contrast silver image even when the diffusible tetrazolium compound is employed. There may also be obtained a stable dot image which is superior to that obtained by the method described in Japanese Patent Application No. 50-94295, when the non-diffusible tetrazolium compound is employed.

The invention is further concretely explained by the following Examples, which by no means restrict the scope of the invention and various many modified embodiments may be possible:

EXAMPLE 1

A silver chlorobromide-gelation emulsion in fine grain size state containing silver halide of 90 mole % of silver chloride, 9 mole % of silver bromide and 1 mole % of silver iodide was chemically sensitized with a sulfur and gold sensitizing agent. This emulsion had an average grain size of 0.25μ and 75% of the whole grains were within a range of 0.19 to 0.31μ in grain size. To this emulsion 8 g of 2,3,5-triphenyltetrazolium chloride per one mole of silver and the equimolar amount of diethylhexylsuccinate sulfonate (hereintoafter, referred to as DES) were added. This emulsion was coated on a polyethylene telephthalate support so as to contain 53 mg of silver/100 $cm^2$ and 50 mg of gelatin/100 $cm^2$. Next, this photographic element was wedge-exposed through a gray contact screen of intermediate tone with a tungsten lamp and processed by the following treatments at 30° C.

Development: 1.5 minutes
Water washing: 1 minutes
Fixing: 2 minutes
Water washing: 5 minutes
Drying.

The following composition were employed in the processing bath:

[Developing solution]
Metol: 3.5 g
Anhydrous sodium sulfite: 60 g
Hydroquinone: 9.0 g
Sodium carbonate: 54 g
Potassium bromide: 2.5 g
5-Nitrobenzimidazole: 0.5 g
1-Phenyl-5-mercaptotetrazole: 10 mg
Water: to make 1 liter (pH=10.25)
[Fixing solution]
Ammonium thiosulfate decahydrate: 150 mg
Anhydrous sodium sulfite: 10 g
Sodium acetate trihydrate: 15 g
Glacial acetic acid: 15 ml
Water: to make 1 liter (pH=6.80)

"Dot quality" here in the examples of this invention means an estimated value of reproduced halftone dot images. Halftone images obtained from the exposed and then developed lith type light-sensitive photographic material are composed of the part called generally "shadow dot" and the part known as "highlight part". There is an intermediate part of various areas in size between both the ends. "Dot quality" here means an evaluated value of the dot in the part having 50% dot in which a half of a definite area is clear and the rest of it is a developed image and the dot quality is expressed in progressive scale. That is, "4" means excellence and "1" extremely badness. The dot quality below 3 can not be generally permitted.

To this emulsion was incorporated exemplified sensitizing dye No. 14 dissolved in methanol in an amount of 200 mg per one mole of silver (Sample 2).

The results obtained are shown in Table 1.

Table 1

| Sample | Sensitizing dye | Development time(s) | Relative sensitivity | Fog | Dot quality |
|---|---|---|---|---|---|
| | No Addition | 60 | 60 | 0.01 | 3.0 |
| | of the dye | 80 | 100 | 0.02 | 3.7 |
| 1 | (outside of | | | | |
| | this | 100 | 120 | 0.03 | 3.3 |
| | invention) | 120 | 130 | 0.04 | 3.0 |
| | | 60 | 70 | 0.01 | 3.3 |
| | Compound No. 14 | | | | |
| | | 80 | 95 | 0.02 | 3.7 |
| 2 | (within this | | | | |
| | invention) | 100 | 100 | 0.02 | 3.7 |
| | | 120 | 110 | 0.02 | 3.3 |

Table 1 shows that the light-sensitive material according to this invention does not vary in specific sensitivity and fog with the development time compared with other materials than this invention and the variation of dot quality is also small.

EXAMPLE 2

A silver halide emulsion was prepared which comprises a silver chlorobromide emulsion containing silver halide of 60 mole % of silver chloride and 40 mole % of silver bromide and of which the average grain size is 0.3μ and 75% of the whole grains is within a range of 0.24 to 0.37μ.

To this emulsion hexaamminecobalt (III) trichloride was added in amount of 4.0 g per one mole of silver. After the sensitizing dye No. 10 was added in an amount of 200 mg per one mole of silver, the emulsion was coated on a polyethylene terephthalate support so as to contain 55 mg of silver per 100 $cm^2$ and 30 mg of gelatin per 100 $cm^2$ and dried.

(Sample 3)

Next, a similar sample was prepared as above except that 3.0 g of 2.5-diphenyl-3-α-napthtyltetrazolium chloride (35) was added instead of hexaamminecobalt (III) trichloride (Sample 4)

These samples were treated in the same way as in Example 1 together with Sample 5 containing no oxidant.

The results are shown in Table 2.

Table 2

| Sample | Development time(s) | Relative sensitivity | Fog | Dot quality |
|---|---|---|---|---|
| Sample 3 | 60 | 30 | — | 2.0 |
| (outside of | 80 | 50 | 0.01 | 2.3 |
| this | 100 | 80 | 0.01 | 2.5 |
| invention) | 120 | 150 | 0.02 | 2.0 |
| | 60 | 80 | 0.01 | 2.7 |
| Sample 4 | | | | |
| | 80 | 100 | 0.01 | 3.5 |
| (within this invention) | 100 | 110 | 0.01 | 3.3 |
| | 120 | 130 | 0.01 | 3.0 |
| Sample 5 | 60 | 130 | 0.03 | extremely bad |
| (outside of | 80 | 180 | 0.07 | extremely bad |
| this | 100 | 220 | 0.10 | Extremely bad |
| invention) | 120 | 280 | 0.20 | extremely |

Table 2-continued

| Sample | Development time(s) | Relative sensitivity | Fog | Dot quality |
|---|---|---|---|---|
| | | | | bad |

Table 2 shows that Sample 4 of this invention has an excellent dot quality compared with Samples 3 and 5.

EXAMPLE 3

A silver halide emulsion which comprises a silver bromide emulsion, in which the average grain size is 0.25μ and about 75% of the whole grains is within a range of 0.19 to 0.31μ, was chemically sensitized with a gold sensitizer. Into this emulsion was added 4-hydroxy-6-methyl-1,3,3a,7-tetrazaindene in an amount of 500 mg per one mole of silver. This emulsion was coated on a polyethylene terephthalate film support in an amount of 50 mg of silver per 100 $cm^2$ and dried. In this case, the following compounds were added after chemical ripening to obtain the following samples.

(Sample 6)

Hexaamminecobalt (III) isopropylnaphthalenesulfonate was added to this emulsion in an amount of 5.0 g per one mole of silver.

(Sample 7)

Compound No. 12 of the sensitizing dye was added to Sample 6 in an amount of 220 mg per one mole of silver.

(Sample 8)

This sample was prepared in the same way as in Sample 7 except that 2,3,5-triphenyl-2H-tetrazolium isopropylnaphthalenesulfonate (tetrazolium Compound (75)) was added in the same mole amount instead of hexaamminecobalt (III) isopropylnaphthalenesulfonate.

(Sample 9)

Tartrazine{4,5-dihydro-5-oxo-1-(4-sulfonyl)-4-[(4-sulfonyl)azo]-1H-pyrazole-3-carboxylic acid trisodium salt} was added to Sample 8 in an amount of 100 mg per one mole of silver.

These samples were treated in the same way as in Example 1 except that they were developed by the following developing solution at 30° C. for 60, 80, 100, 120 and 140 seconds. Composition of the developing solution 1-Phenyl-3-pyrazolidone: 0.8 g
Anhydrous sodium sulfite: 45 g
Potassium hydroxide: 10 g
Hydroquinone: 20 g
Anhydrous sodium carbonate: 20 g
6-Nitroindazole: 0.1 g
Pure water: to make 1 l The results obtained are shown in Table 3.

Table 3

| Sample | Development time(s) | Relative sensitivity | Fog | Dot quality |
|---|---|---|---|---|
| | 60 | 20 | 0.01 | 2.0 |
| | 80 | 80 | 0.01 | 3.0 |
| Sample 6 | 100 | 100 | 0.02 | 3.2 |
| | 120 | 140 | 0.03 | 3.0 |
| | 140 | 170 | 0.04 | 2.5 |
| | 60 | 35 | 0.01 | 2.5 |
| | 80 | 80 | 0.01 | 3.0 |
| Sample 7 | 100 | 95 | 0.01 | 3.5 |
| | 120 | 107 | 0.02 | 3.7 |
| | 140 | 120 | 0.03 | 3.0 |
| | 60 | 60 | 0.00 | 3.0 |
| | 80 | 85 | 0.01 | 3.5 |
| Sample 8 | 100 | 100 | 0.01 | 3.8 |
| | 120 | 100 | 0.01 | 3.8 |
| | 140 | 103 | 0.01 | 3.5 |
| | 60 | 55 | 0.00 | 3.0 |

Table 3-continued

| Sample | Development time(s) | Relative sensitivity | Fog | Dot quality |
|---|---|---|---|---|
| | 80 | 80 | 0.01 | 3.5 |
| Sample 9 | 100 | 97 | 0.01 | 4.0 |
| | 120 | 102 | 0.01 | 4.0 |
| | 140 | 107 | 0.01 | 3.5 |

Table 3 shows the following facts: even in the case of using non-diffusible oxidants except the tetrazolium salt, some effects could be expected but the use of the tetrazolium salt produced remarkable effects. The use of an irradiation prohibiting dye such as Tartrazine except the sensitizing dye has some effects for raising the dot quality but has no effect for processing stably the development and giving stable characteristics as in this invention.

EXAMPLE 4

In this example the same emulsion as in Example 3 was used and the following compounds were added after the emulsion was chemically sensitized.

(Sample 10)

3-(p-Hydroxyphenyl)-5-methyl-2-phenyl-2H-tetrazolium chloride (tetrazolium Compound (18)) was added in an amount of 3.0 g per one mole of silver.

(Sample 11)

To sample 10 was further added Compound No. 23 of the sensitizing dye in amount of 150 mg per one mole of silver.

These sample were treated with the same development process as in Example 1 except that they were developed for 80, 100, 120 and 140 seconds.

The results obtained are shown in Table 4.

Table 4

| Sample | Development time(s) | Relative sensitivity | Fog | γ | Dot quality |
|---|---|---|---|---|---|
| | 80 | 55 | 0.00 | 4.0 | 2.0 |
| Sample 10 | 100 | 87 | 0.01 | 8.0 | 2.7 |
| | 120 | 110 | 0.03 | 10.0 | 3.0 |
| | 140 | 135 | 0.05 | 9.3 | 2.7 |
| | 80 | 80 | 0.01 | 7.0 | 2.5 |
| Sample 11 | 100 | 100 | 0.01 | 10.0 | 3.0 |
| | 120 | 107 | 0.02 | 10:0 | 3.0 |
| | 140 | 112 | 0.03 | 9.5 | 3.0 |

Table 4 shows that the sample, in which the sensitizing dye was added, has a higher stability during the development process than that having no addition.

EXAMPLE 5

This sample was prepared in the same way as in Example 4 using the dye compound No. 23 so as to have an average grain size of 0.25μ by mixing single diffraction emulsions having 0.015μ and 0.035μ at peaks.

The results obtained are shown in Table 5.

Table 5

| Sensitizing dye | Development time(s) | Relative sensitivity | Fog | Dot quality |
|---|---|---|---|---|
| | 60 | 45 | 0.01 | 1.5 |
| No addition | 80 | 100 | 0.02 | 2.0 |
| | 100 | 130 | 0.03 | 2.5 |
| | 120 | 150 | 0.04 | 1.5 |
| 200 mg of Compound | 60 | 55 | 0.01 | 1.5 |
| 23 was added per | 80 | 110 | 0.02 | 2.0 |
| one mole of | 100 | 137 | 0.03 | 2.7 |

Table 5-continued

| Sensitizing dye | Development time(s) | Relative sensitivity | Fog | Dot quality |
|---|---|---|---|---|
| silver | 120 | 155 | 0.03 | 2.0 |

Table 5 shows that sufficient effects can not obtained when the grain size distribution is wider than the scope of that of this invention.

What is claimed is:

1. A light-sensitive silver halide photographic material which material consists essentially of a support, at least one hydrophilic colloidal layer coated thereon which contains silver halide grains having an average grain size of from 0.05 to 1.4μ and at least 75% of which grains being within a range of 0.6 to 1.4 times the average grain size, a tetrazolium compound and a sensitizing dye; said tetrazolium compound being selected from the group consisting of a compound of formulae (I), (II) or (III):

(I)

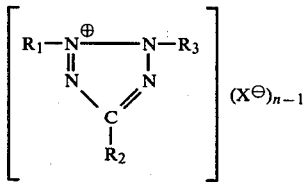

(II)

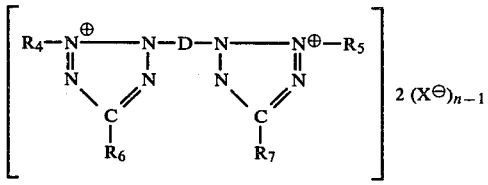

(III)

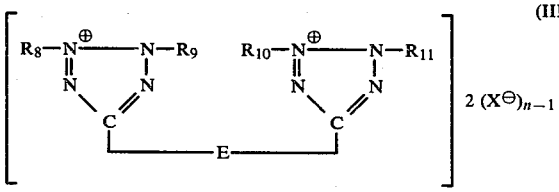

wherein $R_1$, $R_3$, $R_4$, $R_5$, $R_8$, $R_9$, $R_{10}$ and $R_{11}$ each represents an aryl group or a heterocyclic group; $R_2$, $R_6$ and $R_7$ each represents an aryl group, a heterocyclic group, an alkyl group, hydroxyl, carboxyl or the salt thereof, an amino group, mercapto, nitro or hydrogen; D represents a divalent aromatic group; E represents an alkylene group, an arylene group or an aralkylene group; X is an anion; said heterocyclic group being selected from the group consisting of a thiadiazolyl, benzothiadiazolyl, oxazolyl, pyrimidinyl, pyridyl and 2,5-dimethylthiadiazolyl group; and n is 1 or 2, provided that the tetrazolium compound forms an intramolecular salt when n is 1; said sensitizing dye being present in said hydrophilic colloidal layer and being selected from the group consisting of a compound of a formula of formulae (IV) through (X);

(IV)

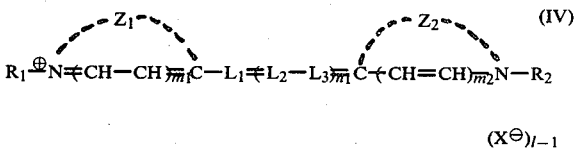

(V)

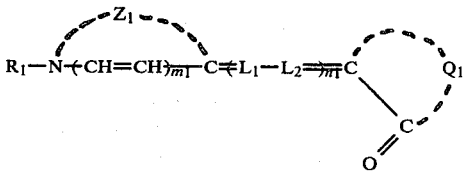

(VI)

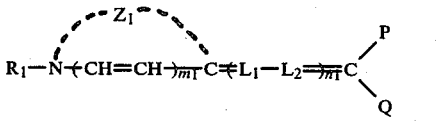

(VII)

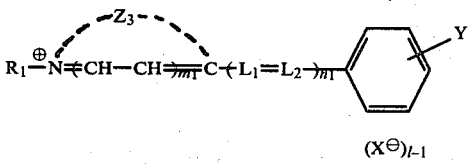

(VIII)

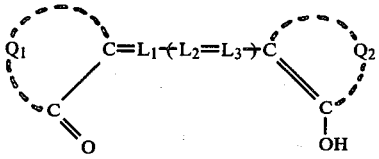

(IX)

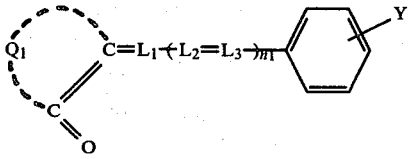

(X)

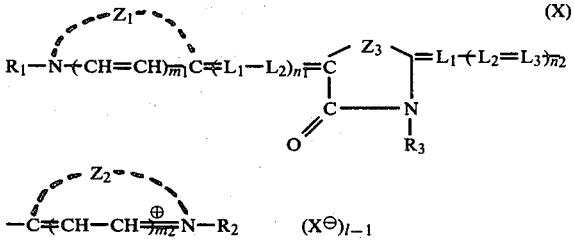

wherein $R_1$, $R_2$ and $R_3$ each represents an alkyl group or an aryl group; $L_1$, $L_2$ and $L_3$ each represents a methynyl group; $Z_1$, $Z_2$ and $Z_3$ each represents an atom or atomic group necessary for forming a 5 to 6-membered heterocyclic ring; P and Q each represents cyano, —$COOR_4$, —$COR_4$ or —$SO_2R_4$ in which $R_4$ represents an alkyl group; $Q_1$ and $Q_2$ each represents an atomic group necessary for forming a thiooxazolone ring, a pyrazolone ring, an oxyindole ring, a barbituric acid, a 2-thiobarbituric acid, a 2,4-oxazolidinedione ring, a 2,4-thiazolidinedione ring, a 2,4-imidazolidinedione ring, a 2-thio-2,4-oxazolidinedione ring, a 2-thio-2,4-thiazolidinedione ring, a 2-thio-2,4-selenazolidinedione ring, a 2-thio-2,5-thiazolidinedione ring, a 2-thio-hydantoinone ring, a 4-oxazolinone ring, a 4-thiazoline ring or a 4-imidazoline ring; Y represents hydrogen, amino, alkylamino, dialkylamino, halogen, an alkoxy group or an alkyl group; $m_1$ and $m_2$ each represents 0 or 1; $n_1$ and $n_2$ each represents 0 or 2; X represents an acid anion group; and l represents 1 or 2 provided that the sensitizing dye compound forms an intramolecular salt when l is 1.

2. A light-sensitive silver halide photographic material according to claim 1 which material is to be treated with a hydroquinone-containing developing solution and consists essentially of a support, at least one hydrophilic colloidal layer coated thereon which contains silver halide grains having an average grain size of from 0.05 to 1.5μ and at least 75% of which grains being within a range of 0.6 to 1.4 times the average grain size, a tetrazolium compound and a sensitizing dye; said tetrazolium compound being selected from the group consisting of a compound of formulae (I), (II) or (III):

(I)

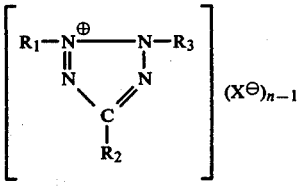

(II)

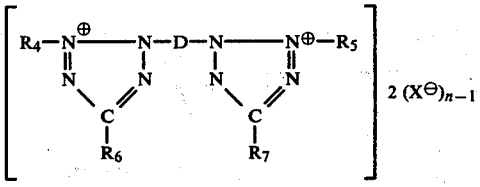

(III)

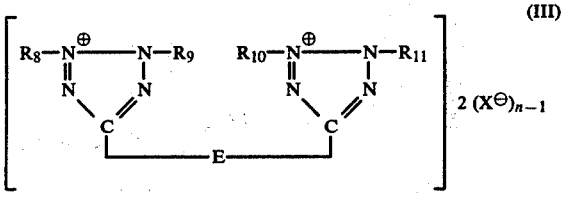

wherein $R_1$, $R_3$, $R_4$, $R_5$, $R_8$, $R_9$, $R_{10}$ and $R_{11}$ each represents an aryl group or a heterocyclic group; $R_2$, $R_6$ and $R_7$ each represents an aryl group, a heterocyclic group, an alkyl group, hydroxyl, carboxyl or the salt thereof, an amino group, mercapto, nitro or hydrogen; D represents a divalent aromatic group; E represents an alkylene group, an arylene group or an aralkylene group; X is an anion; said heterocyclic group being selected from the group consisting of a thiadiazolyl, benzothiadiazolyl, oxazolyl, pyrimidinyl, pyridyl and 2,5-dimethylthiadiazolyl group; and n is 1 or 2, provided that the tetrazolium compound forms an intramolecular salt when n is 1; said sensitizing dye being present in said hydrophilic colloidal layer and being selected from the group consisting of a compound of a formula of formulae (IV) through (X):

(IV)

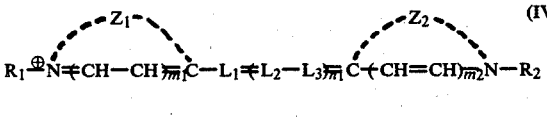

(V)

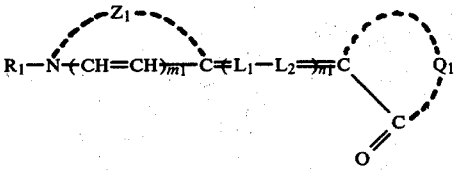

-continued (VI)

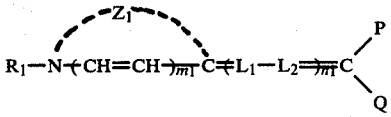

(VII)

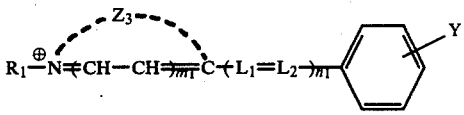

(VIII)

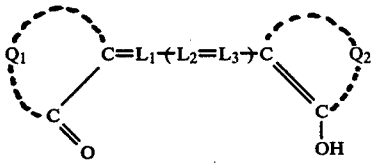

(IX)

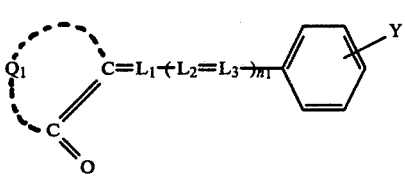

(X)

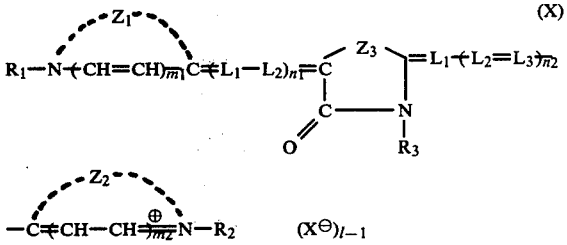

wherein $R_1$, $R_2$ and $R_3$ each represents an alkyl group or an aryl group; $L_1$, $L_2$ and $L_3$ each represents a methynyl group; $Z_1$, $Z_2$ and $Z_3$ each represents an atom or atomic group necessary for forming a 5 to 6-membered heterocyclic ring; P and Q each represents cyano, —$COOR_4$, —$COR_4$ or —$SO_2R_4$ in which $R_4$ represents an alkyl group; $Q_1$ and $Q_2$ each represents an atomic group necessary for forming a thiooxazolone ring, a pyrazolone ring, an oxgindole ring, a barbituric acid, a 2-thiobarbituric acid, a 2,4-oxazolidinedione ring, a 2,4-thiazolidinedione ring, a 2,4-imidazolidinedione ring, a 2-thio-2,4-oxazolidinedione ring, a 2-thio-2,4-thiazolidinedione ring, a 2-thio-2,4-selenazolidinedione ring, a 2-thio-2,5-thiazolidinedione ring, a 2-thio-hydantoine ring, a 4-oxazolinone ring, a 4-thiazolinone ring or a 4-imidazoline ring; Y represents hydrogen, amino, alkylamino, dialkylamino, halogen, an alkoxy group or an alkyl group; $m_1$ and $m_2$ each represents 0 or 1; $n_1$ and $n_2$ each represents 0 or 2; X represents an acid anion group; and l represents 1 or 2 provided that the sensitizing dye compound forms an intramolecular salt when l is 1.

3. A light-sensitive silver halide photographic material according to claim 1 wherein the tetrazolium compound is non-diffusible.

4. A light-sensitive silver halide photographic material according to claim 1 wherein the tetrazolium compound is diffusible.

5. A light-sensitive silver halide photographic material according to claim 1 wherein the hydrophilic colloidal layer is a gelatin layer.

6. A light-sensitive silver halide photographic material according to claim 1, wherein the silver halide is silver chlorobromide or silver chloroiodobromide containing at least 50 mole % silver chloride and having an average grain size of from 0.1 to 0.5μ and having at least 80% grains being within a range of 0.7 to 1.3 times the average grain size.

7. A light-sensitive silver halide photographic material according to claim 1 wherein the light-sensitive silver halide photographic material further comprises an outermost gelatin protective layer having a thickness of from 0.1 to 10μ on the hydrophilic colloidal layer.

8. A light-sensitive silver halide photographic material according to claim 1 wherein the hydrophilic colloidal layer contains the tetrazolium compound.

9. A light-sensitive silver halide photographic material according to claim 8 wherein the hydrophilic colloidal layer further contains the sensitizing dye.

10. A light-sensitive silver halide photographic material according to claim 1 wherein the photographic material further comprises a gelatin layer adjacent to the hydrophilic colloidal layer, the gelatin layer containing the tetrazolium compound while the hydrophilic colloidal layer contains the sensitizing dye.

11. A light-sensitive silver halide photographic material according to claim 1, wherein said sensitizing dye is selected from the group consisting of:

1.

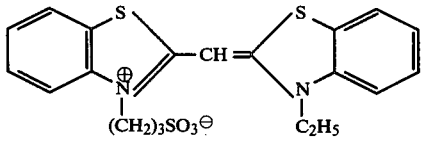

2.

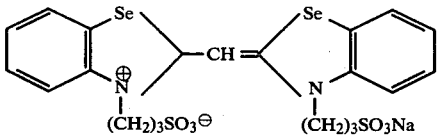

3.

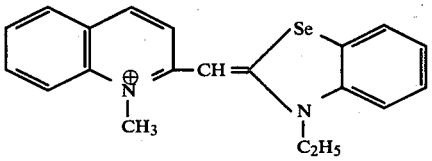

4.

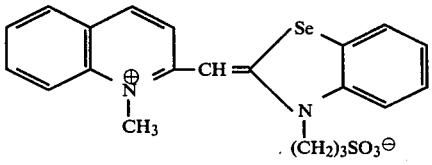

5.

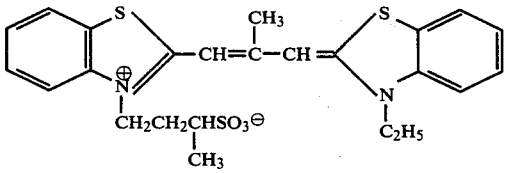

6.

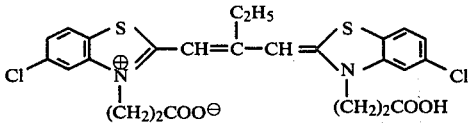

-continued

7.

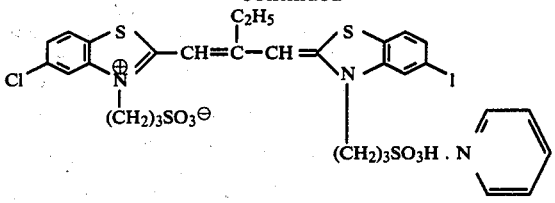

8.

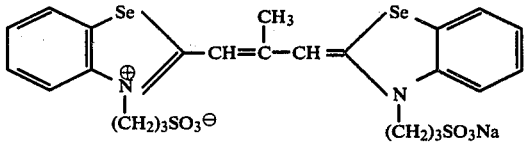

9.

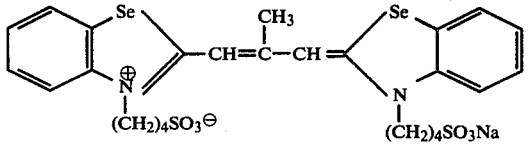

10.

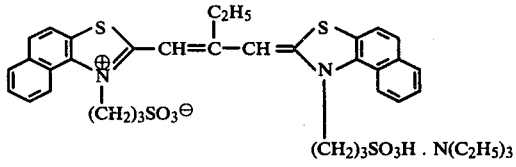

11.

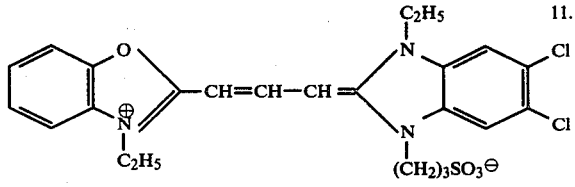

12.

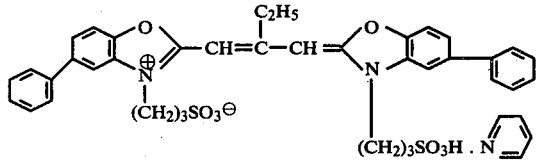

13.

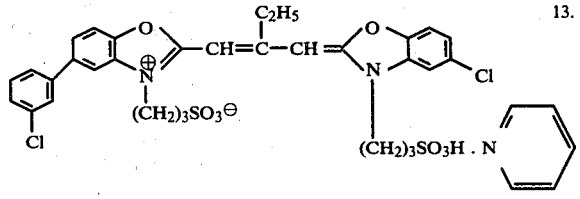

14.

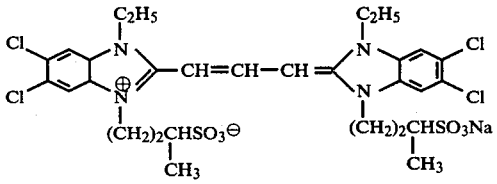

15.

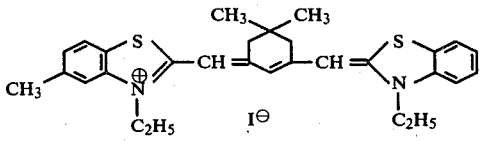

-continued
16.
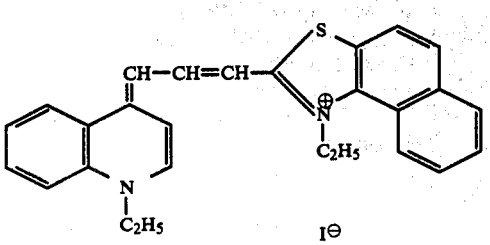
17.
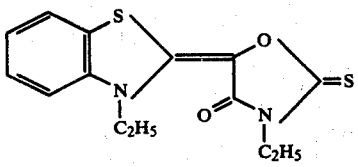
18.
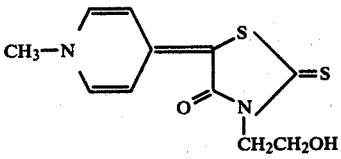
19.
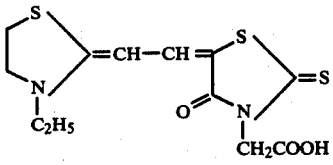
20.
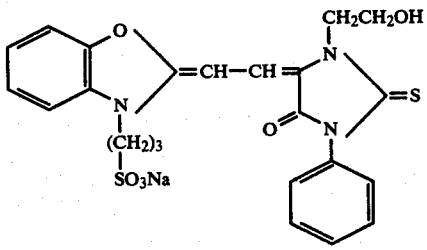
21.
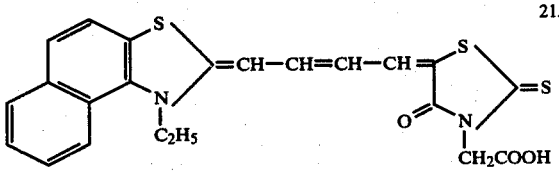
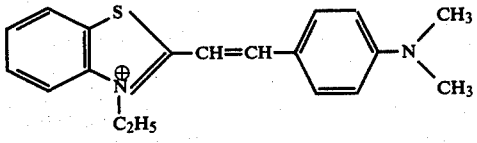
22.
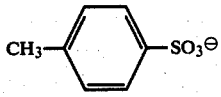
-continued
23.
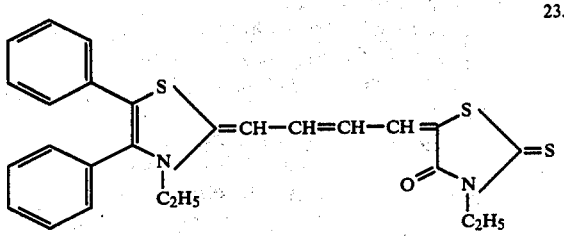
24.
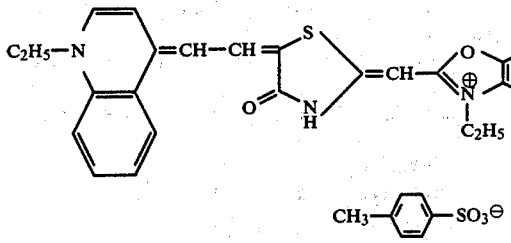
25.
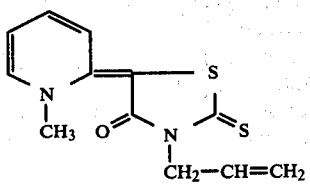
26.
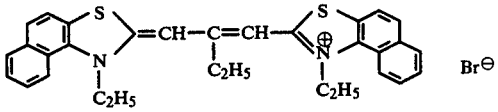
27.
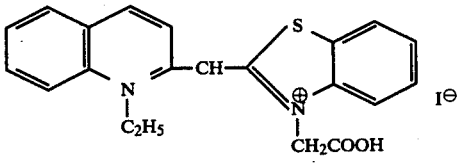
28.
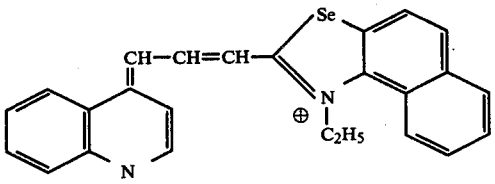
29.
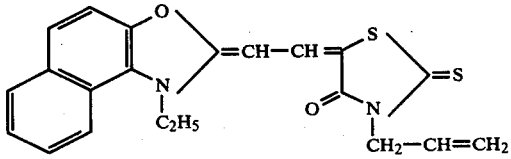
12. A light-sensitive silver halide photographic material according to claim 1, wherein said tetrazolium compound is selected from the group consisting of:
(1) 2-(Benzothiazol-2-yl)-3-phenyl-5-dodecyl-2H-tetrazolium
(2) 2,3-Diphenyl-5-(4-t-octyloxyphenyl)-2H-tetrazolium
(3) 2,3,5-Triphenyl-2H-tetrazolium
(4) 2,3,5-Tri(p-carboxyethylphenyl)-2H-tetrazolium (5) 2-(Benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4-Cyanophenyl)-2,3-diphenyl-2H-tetrazolium
(23) 3-(p-Acetamidophenyl)-2,5-diphenyl-2H-tetrazolium
(24) 5-Acetyl-2,3-diphenyl-2H-tetrazolium
(25) 5-(Fur-2-yl)-2,3-diphenyl-2H-tetrazolium
(26) 5-(Thien-2-yl)-2,3-diphenyl-2H-tetrazolium
(27) 2,3-Diphenyl-5-(pyrid-4-yl)-2H-tetrazolium
(28) 2,3-Diphenyl-5-(quinol-2-yl)-2H-tetrazolium
(29) 2,3-Diphenyl-5-(benzoxazol-2yl)-2H-tetrazolium
(30) 2,3-Diphenyl-5-nitro-2H-tetrazolium
(31) 2,2',3,3'-Tetraphenyl-5,5'-1,4-butylene-di-(2H-tetrazolium)
(32) 2,2',3,3'-Tetraphenyl-5,5'-p-phenylene-di-(2H-tetrazolium)
(33) 2-(4,5-Dimethylthiazol-2-yl)-3,5-diphenyl-2H-tetrazolium
(34) 3,5-Diphenyl-2-(triazin-2-yl)-2H-tetrazolium
(35) 2-(Benzothiazol-2-yl)-3-(4-methoxyphenyl)-5-phenyl-2H-tetrazolium
(36) 2,5-Diphenyl-3-α-naphthyl-2H-tetrazolium, and
(37) 3,3'-(3,3'-Dimethoxy-4,4'-diphenylene)-2,2',5,5'-tetraphenyl-di-(2H-tetrazolium).

13. A method of processing a light-sensitive silver halide photographic material, after imagewise exposure to light, with a developing solution containing a hydroquinone and Metol or phenidone, which material comprises a support, at least one hydrophilic colloidal layer containing silver halide grains having an average grain size of from 0.05 to 1.5μ and at least 75% grains being from 0.6 to 1.4 times the average grain size, a tetrazolium compound and a sensitizing dye, said tetrazolium compound and said sensitizing dye being defined in claim 1.

* * * * *